United States Patent [19]

Smith et al.

[11] 4,407,878

[45] Oct. 4, 1983

[54] LOAD-BEARING HOLLOW CORE BASE PANEL

[76] Inventors: Graydon E. Smith, 13861 18th Ave. SW., Seattle, Wash. 98166; Barry J. Lewis, 31511 41st Ave. SW., Federal Way, Wash. 98003

[21] Appl. No.: 242,022

[22] Filed: Mar. 9, 1981

[51] Int. Cl.[3] ..... B32B 9/00

[52] U.S. Cl. ..... 428/119; 428/167; 428/179; 108/51.1; 52/309.9; 52/309.11

[58] Field of Search ..... 428/119, 120, 167, 179; 220/1.5; 108/51.1; 52/309.9, 309.11

[56] References Cited

U.S. PATENT DOCUMENTS 4,050,756 9/1977 Moore ..... 428/119

4,228,744 10/1980 Moore ..... 428/119

*Primary Examiner*—George F. Lesmes

*Assistant Examiner*—Beverly K. Johnson

*Attorney, Agent, or Firm*—Christensen, O'Connor, Johnson & Kindness

[57] ABSTRACT

A portable airfreight container base panel or other load-bearing panel of hollow core reinforced construction comprising top and bottom sheets interconnected and maintained in parallel relationship by spaced parallel ribs, with the top sheet additionally supported by non-fastened intercostal tubular columns bridging between sheets and maintained in preselected design positions, suited to the specific load requirements of individual applications, by one or more styrofoam retainer sheets or equivalent means apertured to receive and hold the columns in position.

9 Claims, 4 Drawing Figures

18
20
16d
4
4
18
16a
16b
16c
20
16c
16e
20
16d 16c
20
16a
16b
18
20
16c

LOAD-BEARING HOLLOW CORE BASE PANEL

BACKGROUND OF THE INVENTION

This invention relates to hollow core load-bearing base panels such as may be incorporated in airfreight containers, load-bearing pallets, vehicle cargo platforms and the like. The invention is herein illustratively described by reference to the presently preferred embodiment thereof; however, it will be recognized that certain modifications and changes therein with respect to details may be made without departing from the essential features involved.

While the attribute of high strength with low tare weight is important in cargo carrier containers generally for truck rail and shipboard applications, it is obviously even more critical in the case of air transport carriers wherein weight savings can save a shipper large sums over a period of time. The base or floor structure of such containers is usually the most vulnerable to overload damage and usually, therefore, the part of the container where weight penalties are paid for the sake of added strength. For instance, the wheels of a loaded forklift truck can impose heavy force concentrations on the top sheet of a hollow core floor or base panel and, if not adequately resisted by underlying support, can cause panel damage. Likewise, a hump or other localized projection on an underlying floor can place undue upwardly directed deflection load on the bottom sheet of the base panel. Simply increasing the thickness of the top sheet and/or increasing the number of underlying panel ribs, or providing cross ribs, interconnecting the top and bottom sheets has not been a satisfactory solution to the problem because of the large addition of weight imposed without commensurate increase in strength.

A broad object of the present invention, therefore, is to substantially strengthen the base panel of a freight container with minimum increase in weight. A related object is to achieve this result with minimum increase in cost of construction of the base panel and without necessity of complicating the same nor of departing from typical or special fabrication procedures used in making up the base structure.

A related object hereof is to provide a versatile supplemental support system for the top and bottom sheets of hollow core container base panels which can be made highly specific to particular load distribution requirements of the container base for each individual application. As a consequence, the invention makes frugally efficient use of any weight increasing elements added to strengthen the base panel. When employing the invention, subassemblies for one basic panel structure can be stocked by a manufacturer and can be efficiently adapted on final assembly to suit the specific load distribution design requirements of each unit or production run of units.

A specific object hereof is to achieve those and related objectives using readily available and relatively inexpensive materials that can be applied and fitted with the simpliest of tools and with a minimum level of skill.

SUMMARY OF THE INVENTION

In accordance with this invention, the above-stated objects and purposes are achieved by incorporating in the intercostal spaces of the hollow core base panel a novel low-cost lightweight means of reinforcement selectively applicable just in those specific areas of the panel where needed and without necessity of otherwise modifying the panel structure.

In the disclosed and preferred embodiment, round, tubular load-bearing columns, unconnected to any base panel component, are interposed between the top and bottom sheets of the panel so as to bear against each in preselected numbers and specifiable design positions in those intercostal spaces and portions of such spaces requiring additional load-bearing stiffness without necessity of incorporating them elsewhere. Design positioning of the tubular load-bearing columns is established and maintained by one or more sheets or strips of styrofoam or similar material retained in the spaces between ribs and side rails of the panel structure and apertured to receive and positionally hold the tubular columns where their presence is required. Inasmuch as styrofoam or equivalent material is so light in weight, the styrofoam positioning strips can be cut to fit closely within the margins of the intercostal regions where used, and thereby provide selective positioning for the reinforcement columns without necessity of securing or fastening the styrofoam strips or the columns themselves to other parts of the base panel. Preferably, the columns are of aluminum, aluminum alloy or other lightweight material capable of assuming high compression loads.

These and other features, objects and advantages of the invention will become more fully evident as the description proceeds with reference to the accompanying drawings.

DETAILED DESCRIPTION

Figure 1:
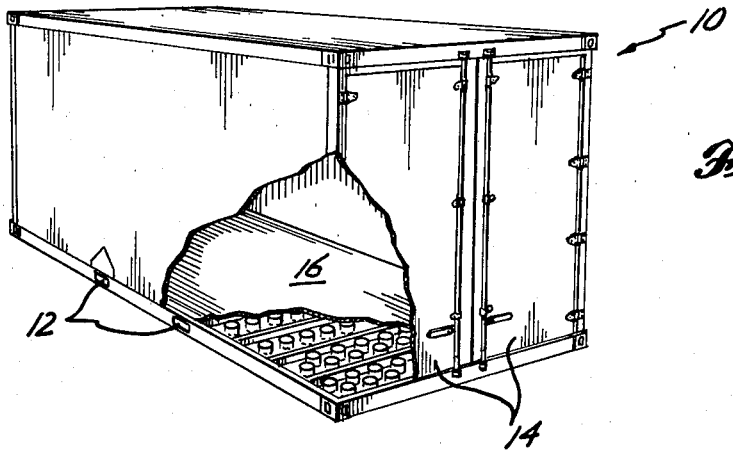
FIG. 1 is an isometric view of a representative airfreight container incorporating the invention, a corner portion of the container and of the top sheet of the container base panel being broken away to show use of the special support elements employed therein.

The illustrated container shown in FIG. 1 comprises an elongated box-like enclosure of the type typically used in airfreight applications to be moved between the interior of large cargo aircraft and a freight dock, truck bed or cargo ship. A number of details are omitted from the illustration since they are or may be conventional, it being sufficient to note that here, as in the typical case, the container may have suitable fittings to receive harness line hooks or other attachments and it may also have base panel slots 12 to receive the forks of a forklift truck. The container is typically large enough to accommodate a forklift truck or other freight carrier by which crates and boxes of cargo are introduced and stowed for shipment. Therefore, the floor or base panel 16 not only must be capable of supporting the cargo itself, but in many applications, and at least in certain areas, also the concentrated forces exerted on the top sheet of the panel by the wheels of the forklift truck doing the work. Opening of the two end doors 14 exposes the full width of the container for ingress and egress of a loaded forklift truck in the typical container design.

The base panel structure itself is or may be conventional and, as such, need not be modified in order to incorporate the illustrated embodiment of this invention. The base panel comprises a top sheet 16*a*, a bottom sheet 16*b* and parallel connecting ribs 16*c* which in this instance are Z-section members having top and bottom flanges rivetted, respectively, to the top sheet 16*a* and bottom sheet 16*b*. Peripheral edge channels 16*d* support the sheets around the edges and provide anchors for fittings 16*e* by which the ends of the ribs 16*e* are connected to the side members 16*d* at opposite sides of the container. As will be seen, the stiffness of the top sheet and the spacing between successive ribs normally determines the ability of the base panel to bear the weight of a concentrated load such as a loaded forklift truck wheel, for instance, without undergoing structural damage. Increasing the thickness of the top sheet, usually an aluminum alloy, increases its ability to sustain bending deflection loads, but not greatly for the percentage of weight increase of the sheet. Likewise, increasing the number of ribs and reducing their spacing naturally also adds to the ability of the top sheet to sustain heavy concentrated bearing loads but at relatively high cost in terms of the weight penalty paid and also in terms of the increased cost of fabrication due to the necessity of rivetting or otherwise securing the ribs to both sheets and usually also to the side members or rails at the ends of the ribs.

Figure 2:
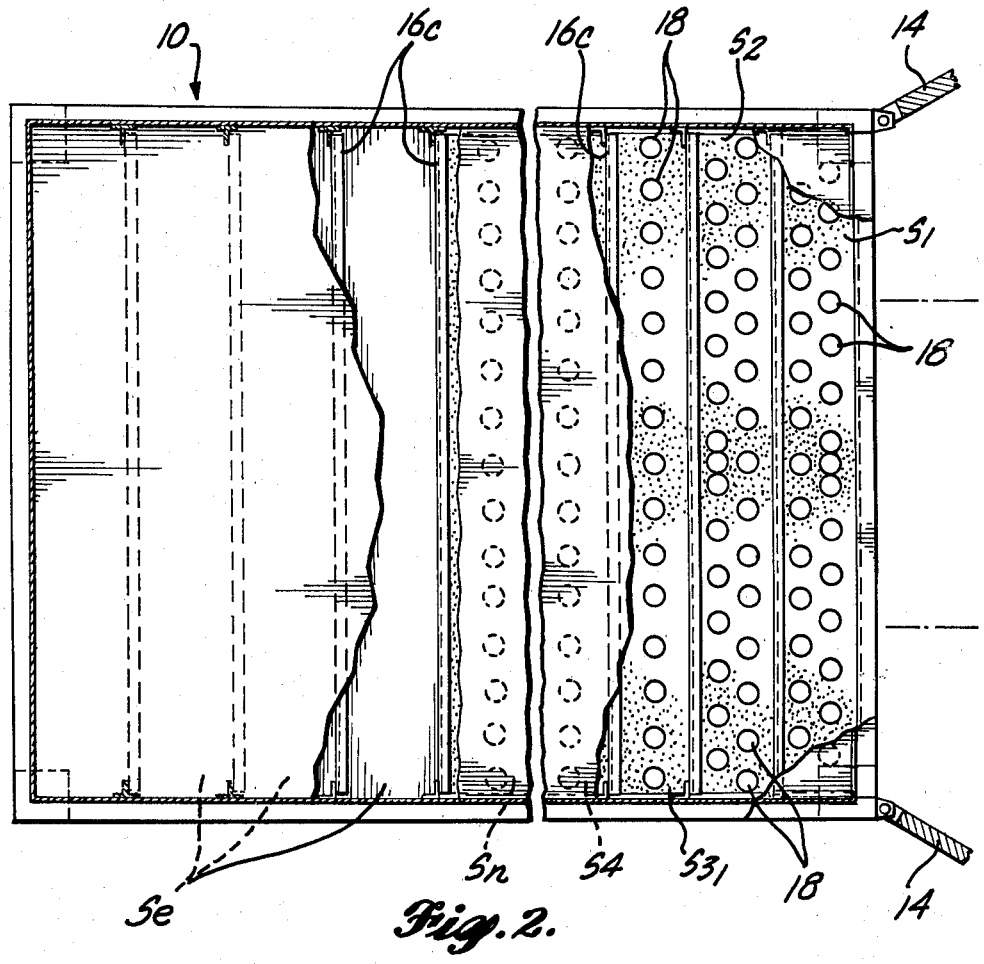
FIG. 2 is a top view of the base panel of such a container with parts broken away to illustrate a typical arrangement of the support elements incorporated therein according to the invention.
Figure 3:
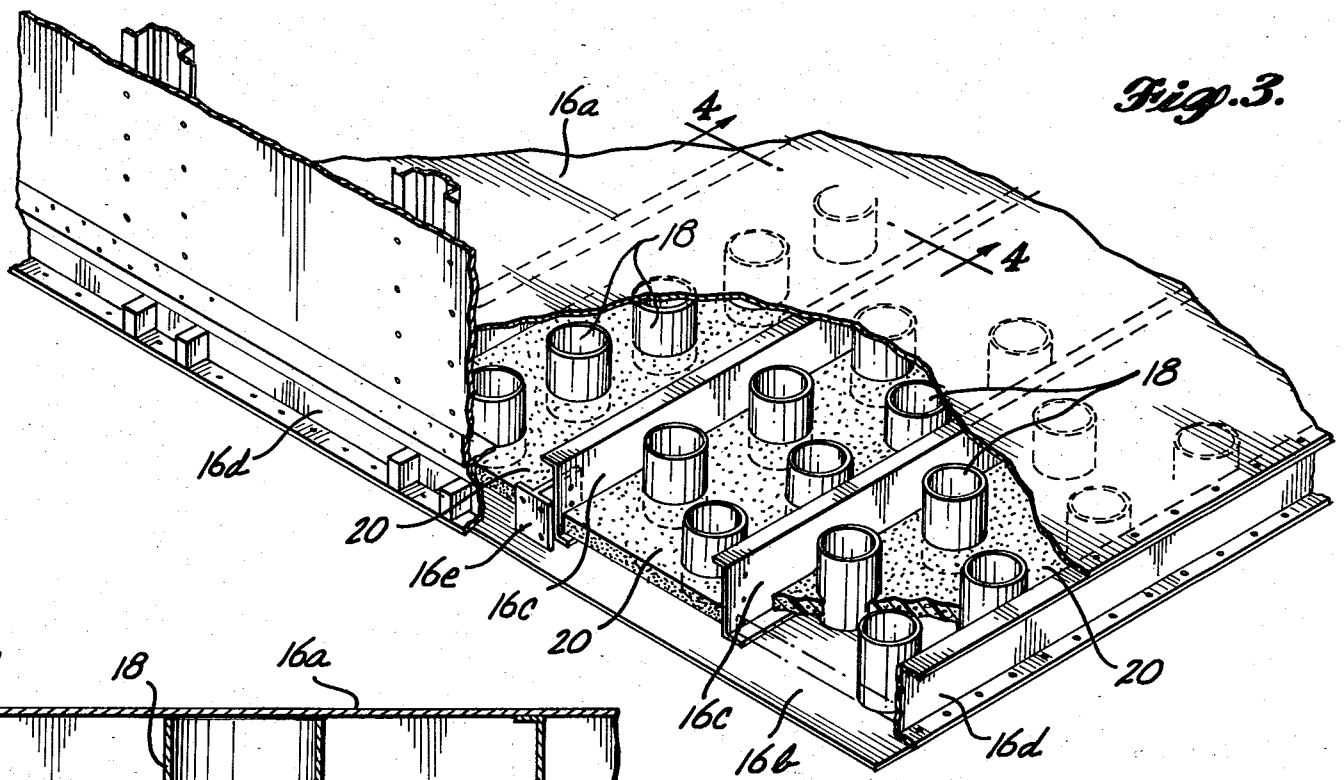
FIG. 3 is an enlarged isometric view of the near corner portion of the container somewhat simplified in the illustration in FIG. 1 with portions broken away to show details of the preferred embodiment of this invention.
Figure 4:
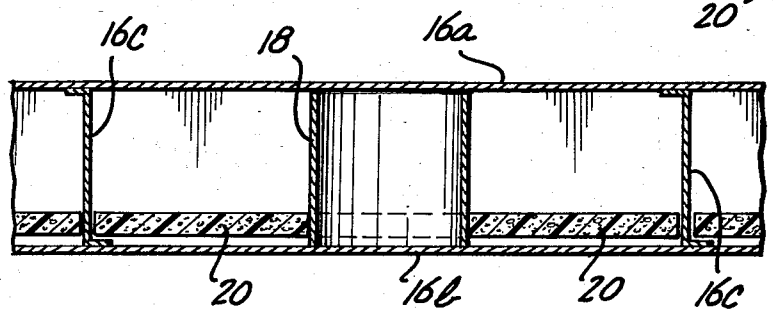
FIG. 4 is a transverse sectional view taken on line 4—4 in FIG. 3.

In accordance with this invention, the required additional support for the top panel to sustain the heaviest concentrated floor loadings anticipated is readily provided in a very simple manner and at very low cost by inserting a plurality of tubular (preferably circular) bearing columns of right cylindrical form between the top and bottom sheets in selected positions designed to provide the additional support exactly where needed. The pattern of distribution of these support columns in the spaces between ribs of the hollow core base panel is readily calculated on the basis of tolerable free span of the top sheet between ribs and adjacent support columns and between adjacent support columns in any direction in locations where concentrated floor loadings may be expected. Such positionings and spacings of these bearing columns that contact the interior faces of top and bottom sheets, but are preferably not fastened to them, is established in the preferred embodiment by one or more sheets or strips of styrofoam or equivalent material 20 apertured to achieve and retain the individual bearing columns at the specified locations. Thus, in the illustration as shown in FIG. 2, at the entry threshold of the container 10 where the wheels of a forklift truck entering and leaving at some speed may bounce or otherwise tend to aggravate the problem of weight load concentration, the spacing between columns is reduced. In succeeding intercostal regions the spacing may be increased since the motion of the advancing forklift truck has steadied out and imposes less severe loading on the top sheet. The innermost intercostal spaces in most instances will require no additional support since the wheels of the forklift truck normally will not traverse those areas due to the length of the forks and the design of the truck. In the illustration, therefore, the first two intercostal spaces S1 and S2 employ two rows of columns 18 arranged with staggered spacing in order to equalize the unsupported span distance between columns and between columns and ribs. The succeeding intercostal spaces S3, S4, . . . Sn wherein support columns 18 are employed are depicted as incorporating a single row of support columns 18 spaced equally from each other by the distance they are spaced from the mutually adjacent sides of the ribs 16*c*. The far end spaces Se are shown without support columns 18.

It has been mentioned that styrofoam sheets 20 are the preferred means of spacing and positioning thhe tubular support columns 18. It will be appreciated that this arrangement is very inexpensive and very light in weight and that its installation involves the simpliest of procedures inasmuch as the sheets are precut substantially to the size of the intercostal spaces so that they themselves remain in a constant position in the plane of the sheet without necessity of holding them by fastenings or other means of securement. As previously stated, the tubular support columns themselves once inserted in the correctly located apertures in the styrofoam sheet need not be fastened to the top or bottom sheets 16*a* and 16*b* to which they are abutted in order for them to provide maximum support between those sheets, it being noted that these columns serve only in compression and not in tension. Preferably, the columns themselves are of aluminum or aluminum alloy and are therefore very light in weight for their load-bearing capacity. Something as lightweight and fragile as styrofoam is adequate to maintain the lightweight load-bearing columns in selected positions in the intercostal spaces inasmuch as there is no lateral forces on these locating sheets even under heavy loading of the top base sheet.

In addition to providing a means of greatly increasing the localized load-bearing capacity of the hollow core base panel in those intercostal spaces requiring it, and without incurring an objectionable weight penalty in so doing, the invention employing the nonfastened load-bearing tubular columns 18 and positioning sheets 20 in no way impedes or retards the manufacturing process involved in fabricating the base panel and container in which it is embodied. In fact, the bottom panel bottom sheet and ribs may be preassembled, leaving only the top sheet to be installed. At the point of final assembly, therefore, the styrofoam sheets, precut to the particular design required for a panel or for a production run of panels, may then be inserted and the associated bearing columns placed in their preformed receiving apertures designed for the particular load-bearing application, following which the top sheet may be installed. If desired, styrofoam sheets of standard size may be prepunched or precut with holes for columns in all possible locations for a manufacturing operation, and only those holes used which are needed for a specific base panel or run of panels.

Accordingly, the system of auxiliary support for the base panel is very versatile and adaptable to any of different application requirements as a customized or production run step of the total fabrication process. Its incorporation adds very little to the cost of fabrication of the container and imposes almost no time delay in completing the assembly.

These and other aspects of the invention and equivalent embodiments thereof will be understood by a person skilled in the art based on the present disclosure of the preferred embodiment thereof.

The embodiments of the invention in which an exclusive property or privilege is claimed are defined as follows:

1. A load-bearing base panel for incorporation in airfreight containers, load-bearing pallets, vehicle cargo platforms and the like, said panel being of hollow core reinforced construction comprising substantially continuous top and bottom structural sheets interconnected and maintained in parallel relationship by transversely spaced reinforcing members, and intercostal additional support means for the top and bottom sheets comprising a plurality of transversely spaced-apart compression load-bearing columns bridging between said top and bottom sheets and having opposing ends abutted but unfastened to said sheets at selected positions in at least certain of the spaces between such reinforcing members, and positioning means maintained in position by contact with a plurality of such reinforcing members and in turn maintaining the columns in spaced-apart positions in each of said spaces.

2. The base panel defined in claim 1, wherein the columns are tubular members.

3. The base panel defined in claim 2, wherein the tubular members are round.

4. A load-bearing base panel for incorporation in airfreight containers, load-bearing pallets, vehicle cargo platforms and the like, said panel being of hollow core reinforced construction comprising substantially continuous top and bottom structural sheets interconnected and maintained in parallel relationship by transversely spaced elongated reinforcing ribs, and intercostal additional support means for the top and bottom sheets comprising a plurality of transversely spaced-apart compression load-bearing columns bridging between said top and bottom sheets and having opposing ends bearing against said sheets in unbonded contact therewith at selected positions in at least certain of the spaces between successive ribs, and positioning means maintaining the columns in spaced-apart positions in each of said spaces, said structural sheets comprising metal sheets, and the positioning means in each such space comprising a substantially rigid sheet multiply apertured to receive and hold the columns positionally in the apertures and fixedly positioned in the space between the ribs adjoining such space.

5. The base panel defined in claim 4, wherein the columns are tubular members.

6. The base panel defined in claim 5, wherein the tubular members are round.

7. A load-bearing base panel for incorporation in airfreight containers, load-bearing pallets, vehicle cargo platforms and the like, said panel being of hollow core reinforced construction comprising substantially continuous top and bottom structural sheets of metal interconnected and maintained in parallel relationship by transversely spaced elongated reinforcing ribs, and intercostal additional support means for the top and bottom sheets comprising a plurality of transversely spaced-apart compression load-bearing columns bridging between said top and bottom sheets and having opposing ends bearing against said sheets in unbonded contact therewith at selected positions in at least certain of the spaces between successive ribs, and positioning means maintaining the columns in spaced-apart positions in each of said spaces, and said positioning means in each such space comprising a substantially rigid sheet of foamed plastic material multiply apertured to receive and hold the columns positionally in the apertures and dimensioned to bridge between the ribs adjoining such space.

8. The base panel defined in claim 7, wherein the columns are tubular members.

9. The base panel defined in claim 8, wherein the tubular members are round.

* * * * *